US006899388B1

(12) United States Patent
Enrique

(10) Patent No.: US 6,899,388 B1
(45) Date of Patent: May 31, 2005

(54) PORTABLE CHAIR AND CANE WITH UMBRELLA

(75) Inventor: Esmeraldo C. Enrique, St. Augustine, FL (US)

(73) Assignee: Enrique Gulf Technology, St. Augustine, FL (US)

( * ) Notice: Subject to any disclaimer, the term of this patent is extended or adjusted under 35 U.S.C. 154(b) by 0 days.

(21) Appl. No.: 10/809,613

(22) Filed: Mar. 25, 2004

(51) Int. Cl.[7] ..... A47C 29/00
(52) U.S. Cl. ..... 297/184.16; 297/129; 297/16.2
(58) Field of Search ..... 248/155, 155.2, 248/155.3, 155.4, 155.5; 135/16, 66, 15.1; 297/16.2, 338, 129, 217.1, 184.15, 184.16, 297/184.1, 344.18

(56) References Cited

U.S. PATENT DOCUMENTS

| | | | | | |
|---|---|---|---|---|---|
| 387,213 | A | * | 8/1888 | Crowley | 135/66 |
| 1,736,893 | A | * | 11/1929 | Venge | 248/155.5 |
| 2,798,536 | A | * | 7/1957 | Shew | 248/155.2 |
| 3,266,839 | A | * | 8/1966 | Combs | 297/57 |
| 3,310,340 | A | * | 3/1967 | Brewer et al. | 297/16.1 |
| 4,317,519 | A | * | 3/1982 | Talley | 206/577 |
| 4,934,638 | A | | 6/1990 | Davis | 248/164 |
| 5,288,131 | A | * | 2/1994 | Singley | 297/452.24 |
| 5,411,313 | A | * | 5/1995 | Counihan et al. | 297/118 |
| 5,709,428 | A | | 1/1998 | Hugghins | 297/16.2 |
| D396,569 | S | | 8/1998 | Chen | D6/368 |
| 5,851,052 | A | | 12/1998 | Gustafsson | 297/16.2 |
| 5,876,091 | A | | 3/1999 | Chernomashentsev | 297/16.2 |
| 5,896,880 | A | * | 4/1999 | Bushweller et al. | 135/16 |
| 6,135,557 | A | | 10/2000 | Gustafsson | 297/344.18 |
| 6,467,843 | B1 | | 10/2002 | Rossborough | 297/344.18 |
| 6,634,704 | B1 | | 10/2003 | Bergquist | 297/16.2 |

FOREIGN PATENT DOCUMENTS

GB 2045338 * 10/1980

OTHER PUBLICATIONS

United States Trademark Application, Ser. No. 78306679, filed on Sep. 29, 2003, for the word mark "*SPORTSEAT*.". Website for "sportseat.com" dated Dec. 27, 1996, including nine pages taken from archive.org beginning with http://web.archive.org/web/19961227193440/http://www.sportseat.com/.
Current website for "sportseat.com" dated Mar. 22, 2004, including ten pages beginning with http://www.sportseat.com/.

* cited by examiner

*Primary Examiner*—Milton Nelson, Jr.
(74) *Attorney, Agent, or Firm*—Brian S. Steinberger; Law Offices of Brian S. Steinberger, P.A.

(57) ABSTRACT

Collapsible and portable seating device and method of using the device is provided with telescoping legs, a cane-function and an umbrella to provide protection from sun, rain and snow. The telescoping legs allow for adjustments for height and sturdiness on uneven contours such as a slope or hill. An umbrella connection on the handle allows for unlimited positioning of the umbrella and folds neatly with the legs when not in use. There are no loose parts in the seating device that has a weight of less than approximately 6 pounds, is easily set-up and folded to a collapsed condition for storage or use as a cane.

15 Claims, 13 Drawing Sheets

110
114
16
120
F
112
15
116
118
17

10
15
18
54
20
52
50

18
16
22
20
17
10

18
16
22
20
17
10

PORTABLE CHAIR AND CANE WITH UMBRELLA

FIELD OF INVENTION

This invention relates to portable seating devices, and in particular to a portable, collapsible, lightweight seating device and method of using with or without an umbrella that is adjustable in height for comfortable seating and when collapsed can be used as an adjustable walking cane.

BACKGROUND AND PRIOR ART

Various types of portable seating devices are known in the prior art. Examples of such portable seating devices are disclosed in U.S. Pat. Nos. 4,934,638 and 5,876,091 describing collapsible tripod stools with telescoping legs, both are without an umbrella attachment or a cane-function. U.S. Patent Des. No. 396,569 describes a design of a cane-functioned collapsible chair that does not appear to have telescoping legs or an umbrella attachment. Also, U.S. Pat. Nos. 5,851,052 and 6,135,557 to Gustafsson are examples of collapsible, portable tripod stools, which are also without an umbrella attachment or cane function. More recently, U.S. Pat. No. 6,634,704 B1 to Bergquist provides a portable, collapsible tripod stool with enhancements to prevent the legs from spreading beyond the supporting position.

A company entitled Sport Seats International appears to be selling a stool-type device called sport seat that claims it can be also used as a cane. However similar to the above, there is no shade attachment for the device and its legs are limited in length and cannot be extended.

None of these devices combine stools or seating devices with any type of shade and protective covers, such as an umbrella for covering and/or protecting the occupants from rain, snow, sun or the like. None of the prior art devices appear to be easily collapsible and portable, yet stable and strong enough to support heavy weights up to 325 pounds, undergo adjustment for individual height and uneven terrain.

Finally, even if the prior art devices are found to be easily collapsible and portable, the devices are known to be unstable, which results in slipping and unsteadiness of the supporting legs and a tendency to collapse under large weights, such as 300 pounds or more.

Thus, the need exists for solutions to the above problems in the prior art. It is desirable to have an easy-to-use, collapsible, portable stool that may be easily transported, or can assist a person in moving from one place to another and used either indoors or in a variety of outdoor conditions, recreational activities and spectator sports where there is a need for comfort and protection from harmful elements, such as over exposure to the sun or protection in the rain. The present invention fills the void in the prior art.

SUMMARY OF THE INVENTION

A primary objective of the present invention is to provide a collapsible and portable tripod stool or seating device and method of using with a shade or protective cover, such as an umbrella.

A secondary objective of the present invention is to provide a collapsible and portable tripod stool or seating device and method of using that can be used as a cane in the collapsed position.

A third objective of the present invention is to provide a collapsible and portable tripod stool or seating device and method of using with adjustable legs for varying the height above a ground surface.

A fourth objective of the present invention is to provide a collapsible and portable tripod stool or seating device and method of using with adjustable legs that can be manipulated for seating stability on uneven terrain, such as a slope or hill.

A fifth objective of the present invention is to provide a collapsible and portable tripod stool or seating device and method of using that can handle weights of up to approximately 325 pounds while remaining sturdy and stable.

A sixth objective of the present invention is to provide a collapsible and portable tripod stool or seating device and method of using having an attached umbrella that folds away neatly when not in use.

A seventh objective of the present invention is to provide a collapsible and portable tripod stool or seating device and method of using with a mechanism for automatically locking and unlocking the umbrella to the handle/leg of the stool.

An eighth objective of the present invention is to provide a collapsible and portable, lightweight tripod stool or seating device and method of using wherein one leg has both a support and a cane function.

A ninth objective of the present invention is to provide a collapsible and portable tripod stool or seating device and method of using that can be easily transported.

A tenth objective of the present invention is to provide a collapsible and portable tripod stool or seating device and method of using with a gooseneck/flexible tubular segment or rod in the shaft supporting the umbrella to allow for unlimited adjustment of the umbrella position.

An eleventh objective of the present invention is to provide a tripod stool or seating device and method of using with an umbrella and cane-function in a structure wherein the components can be folded and collapsed into a compact bundle having no loose parts, for easy transport and storage.

A twelfth objective of the present invention is to provide a collapsible and portable tripod stool or seating device and method of using that can be used indoors and outdoors.

The portable, collapsible seating device with an umbrella attachment includes a solid, break-resistant seating surface, an optional cushion attachable to the seating surface, a plurality of leg members for both cross-bracing and supporting the seating surface over a ground surface, the leg members being moveable between an assembled position and a folded position, where the assembled position fully supports weighted objects being placed on the seating surface and the folded position has the seat in a collapsed position allowing the seat to become portable and easy to carry.

A person can easily carry the seat from place to place, as when watching a golf tournament or hiking. The novel seat can be used for individuals of varying height and weights up to approximately 325 pounds in size, and can be used indoors and outdoors as needed. The novel seat can be used on uneven terrain surfaces.

Methods of using the device can range from a collapsed position where the device is used as a walking cane to an expanded version where the device is a chair/seat with raised opened/closed umbrella and extendable legs for use on uneven terrain.

Further objects and advantages of this invention will be apparent from the following detailed description of the presently preferred embodiments, which are illustrated schematically in the accompanying drawings.

DESCRIPTION OF THE PREFERRED EMBODIMENTS

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

"Seating device" is used interchangeably with "tripod stool" and "chair" herein. However, it is readily apparent that the novel device is much more than a stool or chair and much more than a seating device, because it is multifunctional, including, but not limited to a seat, a cane, a protective covering from sun, rain, snow and the like. It can also provide relief from aching feet, legs and back muscles.

Figure 1:
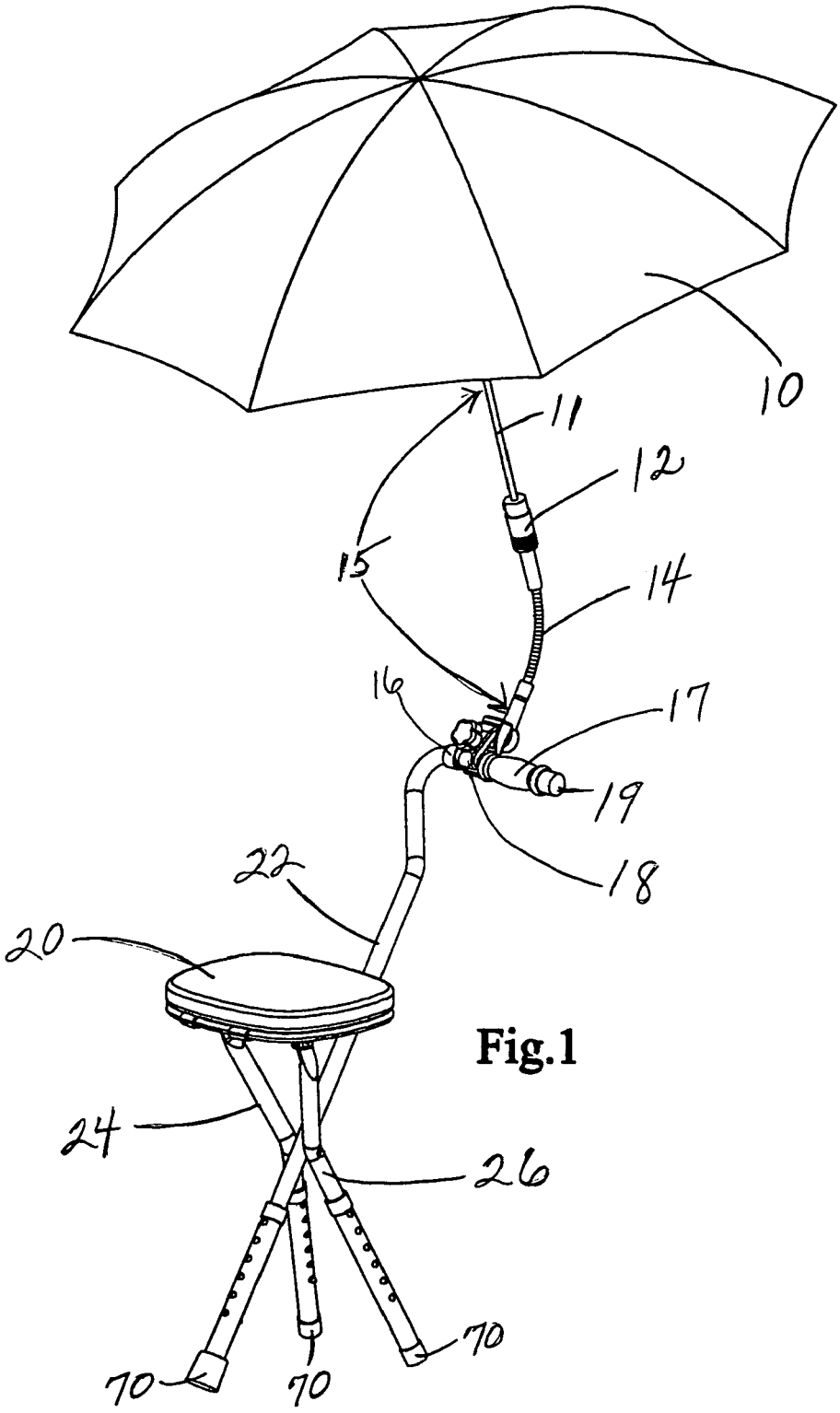
FIG. 1 is a perspective view of the novel portable, collapsible, seating device fully assembled with the umbrella raised and open.

In FIG. 1, the fully assembled seating device is shown with the umbrella 10 open and in a raised position. The shaft 15 supporting the umbrella 10 comprises a telescoping umbrella pole 11, fitted with a socket-like connection 12 that receives the lower most portion of the umbrella pole 11 and the upper most end of a flexible tubing piece 14. The gooseneck flexible tubing 14 is preferably 304 stainless steel tubing approximately 1 inch in diameter and available from a supplier of flexible metallic tubing, such as, Armor Associates, Inc. in Malvern, Pa. The umbrella 10 and telescoping umbrella pole 11 are commercially available from any establishments selling umbrellas, such as Sharper Image or Brookstone's (in USA); it is preferable to use an umbrella that opens automatically and has a gust proof canopy construction. The umbrella canopy can be of any color, including the camouflage design and camouflage color used in military and outdoor activities such as hunting, bird-watching and the like.

The socket-like connection 12 that receives the umbrella pole 11 on the upper end and the gooseneck flexible tubing piece 14 on the lower end can be formed of any rigid, break-resistant material, including, but not limited to, fiberglass, polyvinyl chloride, aluminum, titanium or other metal or even wood. The umbrella pole 11 and gooseneck flexible tubing 14 are secured in the socket-like connection 12 with glue, screws or other means to connect all segments of shaft 15, so that there are no loose parts.

Figures 16, 16A, 17, 18:
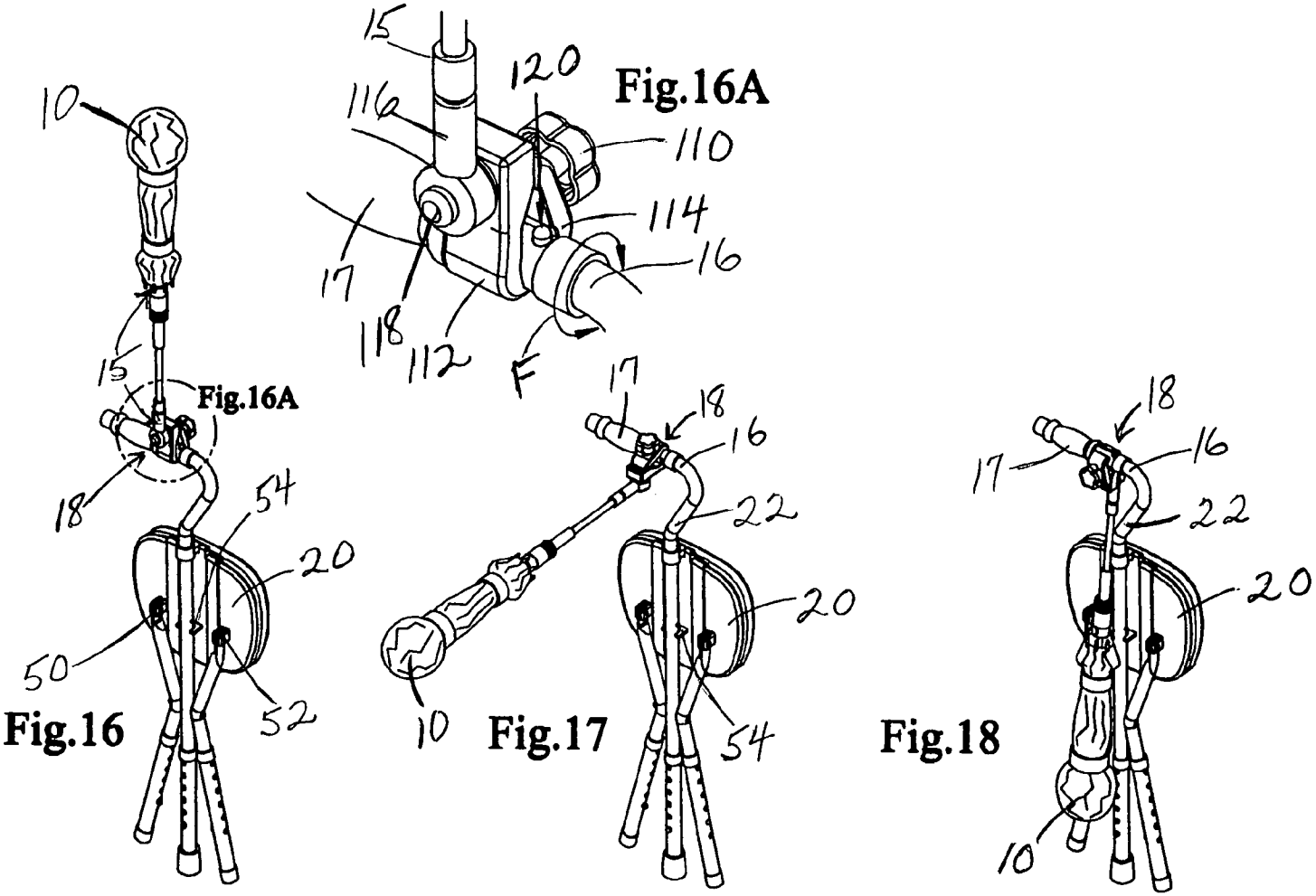
FIG. 16 is a perspective view of the collapsed seating device with the umbrella raised and closed showing the rotating handle attachment for the umbrella.
FIG. 16A is a perspective view of the rotating handle used to attach an umbrella to the seating device.
FIG. 17 is a view of the umbrella rotated 90 degrees from the vertical position.
FIG. 18 is a view of the umbrella rotated downward 180 degrees from the vertical position.

Referring again to FIG. 1, the remainder of the novel seating device includes a cane handle 16, covered by a rubber gripping surface 17 with a plastic end cap 19. The end cap 19 covers and provides an aesthetic appearance to the end of the tubular handle 16 on leg 22. A yoke 18 forms an integral part of the lower most end of the gooseneck flexible tubing 14 and is secured by a clamping mechanism to cane handle 16. The yoke 18 controls the overall position of shaft 15, including the raising and lowering of the shaft and umbrella in a direction that is approximately 180 degrees to the left of the seat 20 and approximately 180 degrees to the right of seat portion 20. The yoke 18 can rotate 360 degrees around handle 16. Thus, yoke 18 can rotate in two ways; first, by loosening it from wherever it is attached or clamped and second, by rotating the handle as shown in FIG. 16A as discussed in greater detail below. Details of the yoke 18 are also shown in FIGS. 19 to 23 and further discussed below. It is readily apparent that the yoke 18 with the unique clamping and rotating mechanism can be attached or clamped to any structure or chair wherein it can be clamped about a portion of the structure or chair, such as, but not limited to, a wheelchair, an electric cart and the like. The yoke 18 with umbrella 10 attached to a flexible and bendable gooseneck tubular segment or rod can provide hands-free, portable, adjustable shade and protection.

The cane handle 16 is the uppermost end of a supporting leg 22 hinged to seat 20, which is also hinged to additional supporting legs 24 and 26.

The cane handle 16 is preferably covered with a rubber grip 17 designed ergonomically for comfort and convenience when the seating device is in the collapsed position and used as a walking support. Referring now to seat 20, the shape can have any comfortable configuration with rounded edges, such as the substantially circular shape of a stool seat. The seat 20 can be made of any solid, break-resistant material, such as wood, metal or plastic, preferably a strong, lightweight material such as lightweight injection molded plastic. FIGS. 1 to 6, 9 to 11, 24 and 25 show the seat 20 with the optional removal seat cushion attached to the solid seat surface.

Turning now to the plurality of leg assemblies 22, 24, and 26, these can be formed of hollow support tubes, or alternatively, formed of solid shafts or other suitable configuration, with the lower most end portion having an adjustable feature that is known in the art, and disclosed in U.S. Pat. Nos. 6,135,557 and 6,467,843 B1, and incorporated herein by reference. The major requirement of the leg supports is that they be attached to communicating hinges or couplings on the seat 20 allowing the seat to fold in a flat vertical position when the seating device is collapsed. For some applications, hollow support tubes made of a lightweight and strong material, such as aluminum may be preferable to minimize the weight of the seating device. The diameter of the leg tubes and the tube wall thickness is preferably selected based on an expected support weight capability. It is desirable to obtain the maximum strength for a minimum tube wall thickness. In one embodiment, the hollow aluminum leg cylinders are approximately 1 inch in diameter and can support the weight of a person weighing approximately 325 pounds. A bottom end of each lower leg 22, 24, 26 includes a rubber cover 70 attached thereto.

Figure 2:
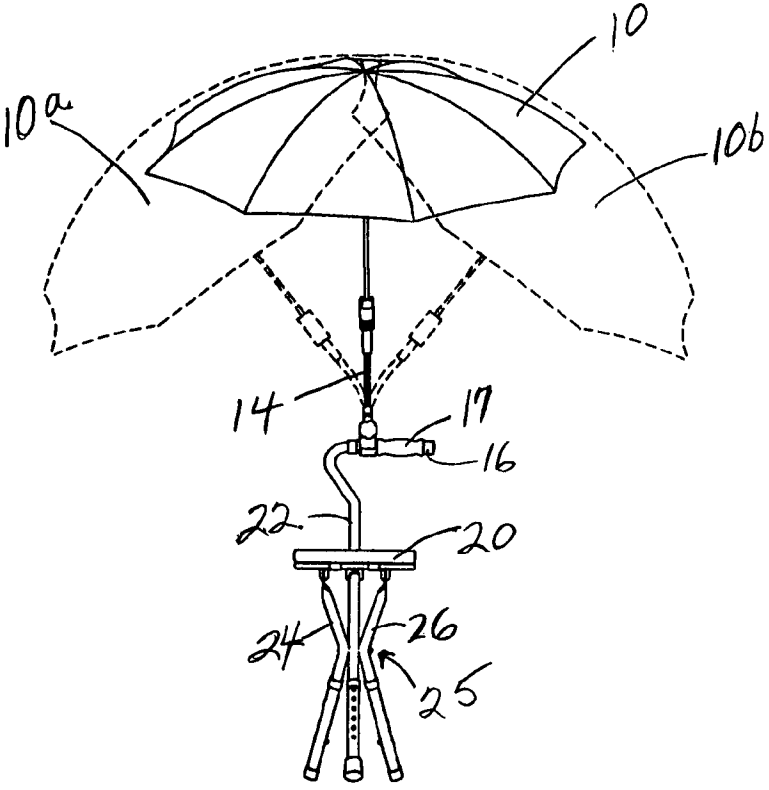
FIG. 2 is a front view of the seating device of FIG. 1.

FIG. 2 is a front view of the fully assembled seating device showing how the raised and opened umbrella 10 can be repositioned from left 10*a* to right 10*b* with reference to handle 16 because of the flexible metallic tubing 14. Additionally, the front view of the tripod leg assemblies shows one leg 22 with handle 16 is a long straight cylindrical leg while legs 24 and 26 are bent into a K shape and positioned as mirror images of each other using the straight cylindrical leg 22 and the vertical part of the K. Each K-shaped supporting leg 24 and 26 has a compressed uppermost end attached to hinges or coupling means under the seat 20. The waist 25 of each K-shaped leg 24, 26 is pivotally attached to the long straight cylindrical leg 22. The pivot joint is connected by threaded or riveted members to provide stability of the legs and prevent mobilization of the legs with respect to one another. The feet of the leg assemblies are angled radially outward from the waist connection 25 to maximize ground surface contact and further stabilize the seating device of the present invention.

Figure 3:
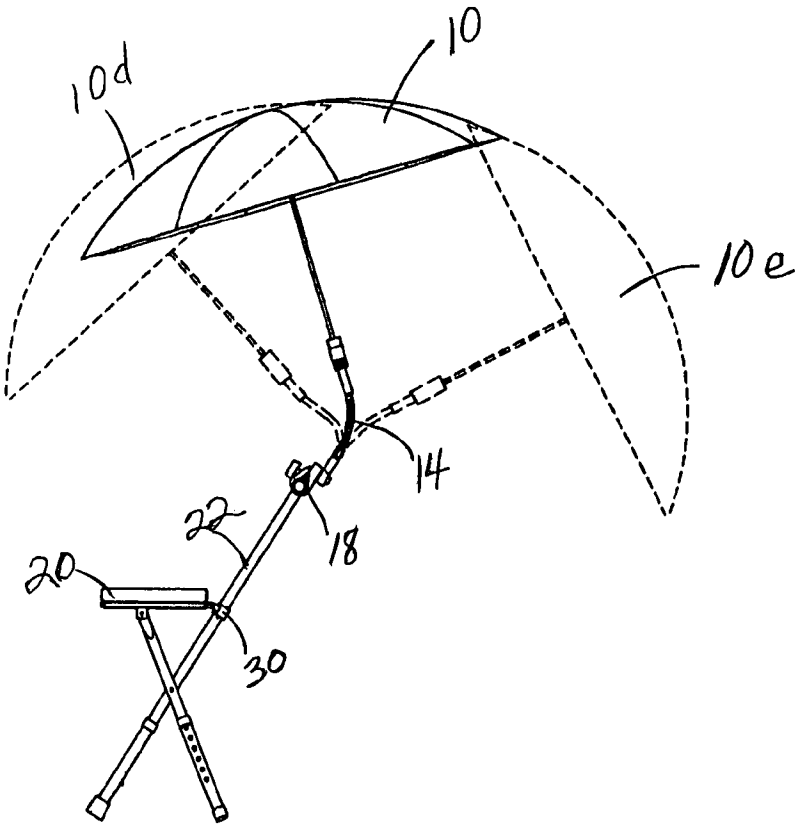
FIG. 3 is a side view of the seating device of FIG. 1.

FIG. 3 is a side view of the fully assembled seating device showing how the umbrella 10 can be repositioned from front 10*d* to back 10*e* because of the flexible metal tubing 14, attached by yoke 18 to the uppermost portion of the long, straight cylindrical leg 22. The long straight cylindrical leg 22 is attached to the seat 20 by a sleeved hinge 30 that allows the seat 20 to drop to a flat vertical position when the seating device is collapsed.

Figure 4:
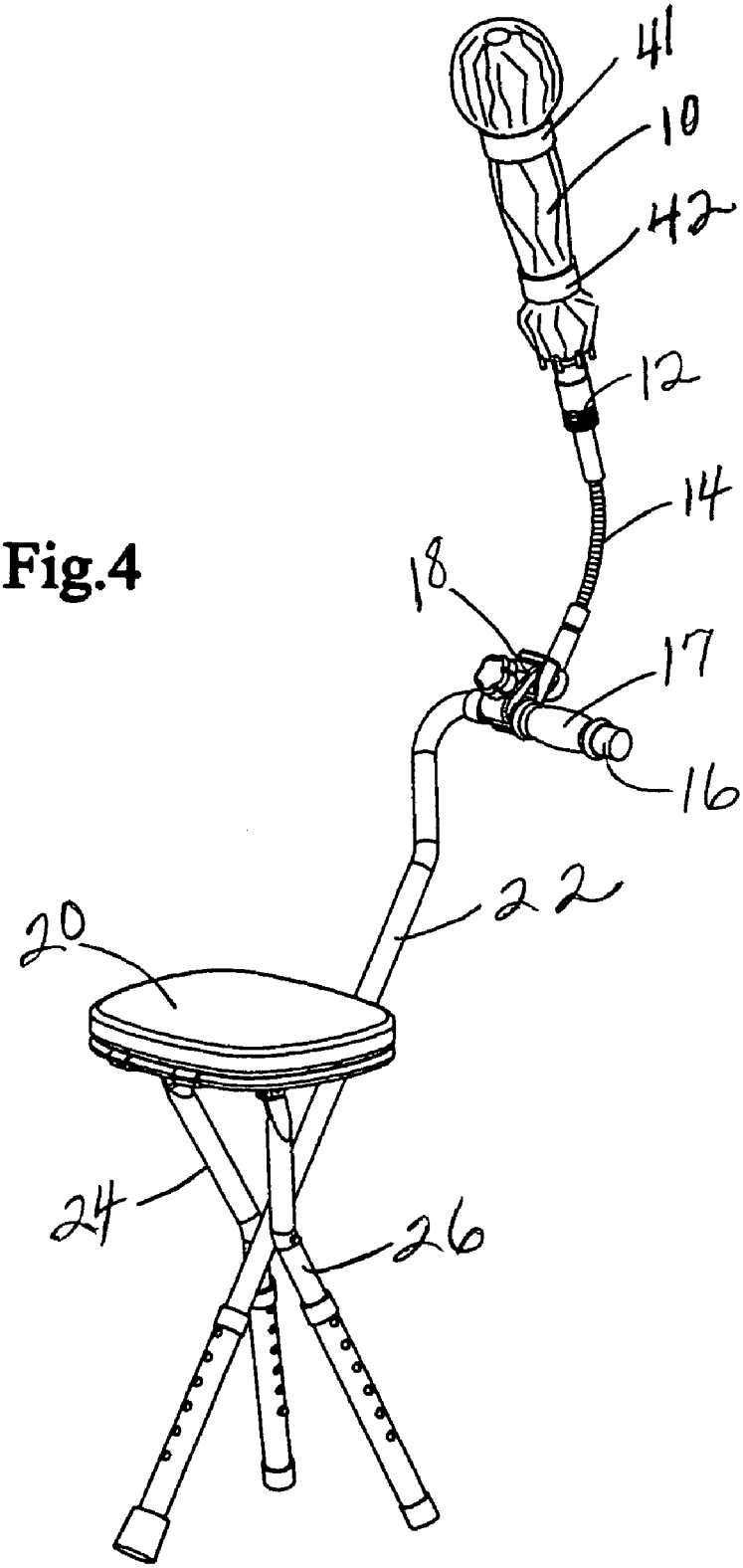
FIG. 4 is a perspective view of the seating device with the umbrella raised and closed.

FIG. 4 is another perspective view of the seating device with the umbrella 10 raised and the umbrella canopy closed and secured with fasteners 41 and 42. The fasteners used to secure the umbrella canopy or the umbrella attachment to the seating device when collapsed, can be made of material selected from the group consisting of nylon, string, leather, material with snaps, hooks and eyes and the like; the preferred fastening means is a hook and loop fastener, such as Velcro®, a nylon fabric that can be fastened to itself.

Figure 6:
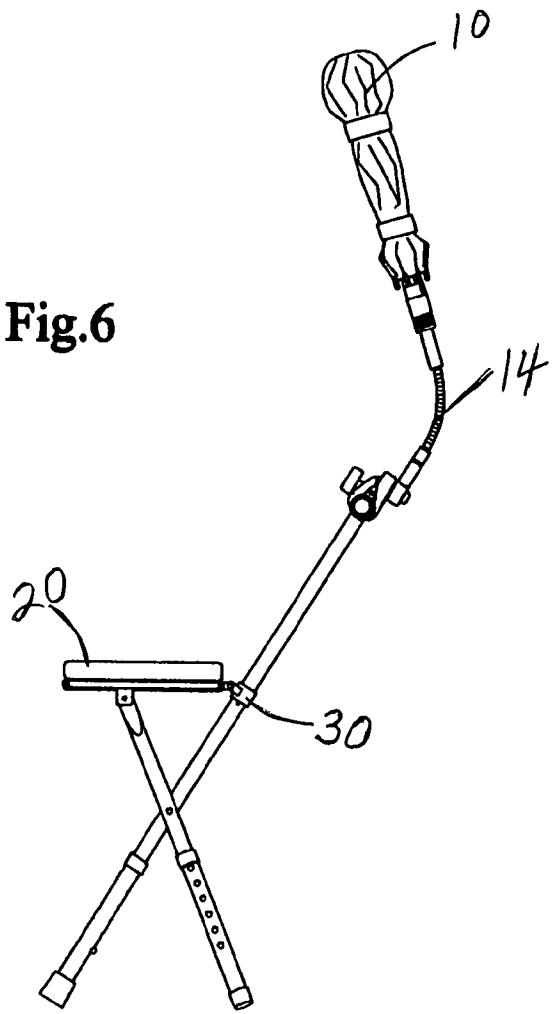
FIG. 6 is a side view of the seating device of FIG. 4.
Figure 5:
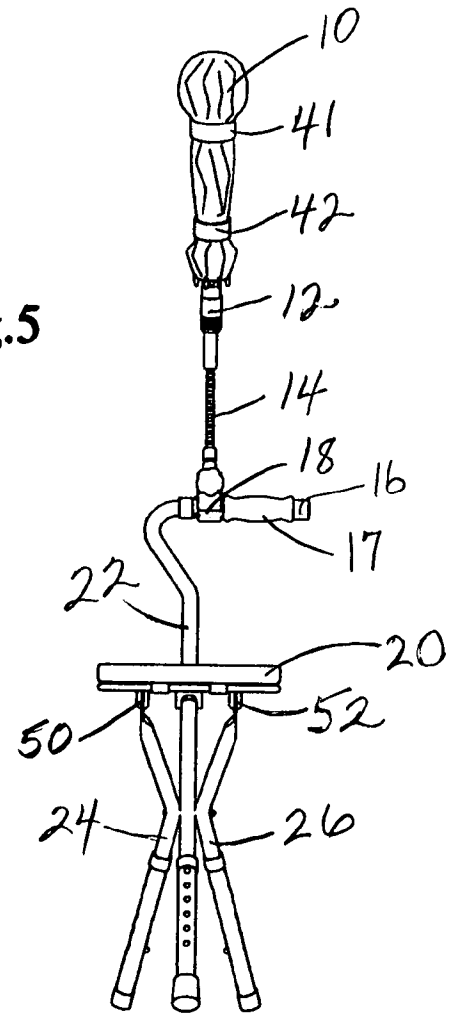
FIG. 5 is a front view of the seating device of FIG. 4.

FIG. 5 is a front view of FIG. 4 showing the position of yoke 18 on handle 16 and the ergonomically curved handle at the upper most end of the long straight cylindrical leg 22. Also shown are the communicating hinges or couplings 50 and 52 that attach the K-shaped legs 24 and 26 respectively, to the bottom of seat 20. FIG. 6 provides a side view of FIG. 5 with umbrella 10 flexed slightly forward by the flexible tubular connection 14. Also shown is the sleeve-like hinge 30 on leg 22 that is connected to seat 20.

Figure 7:
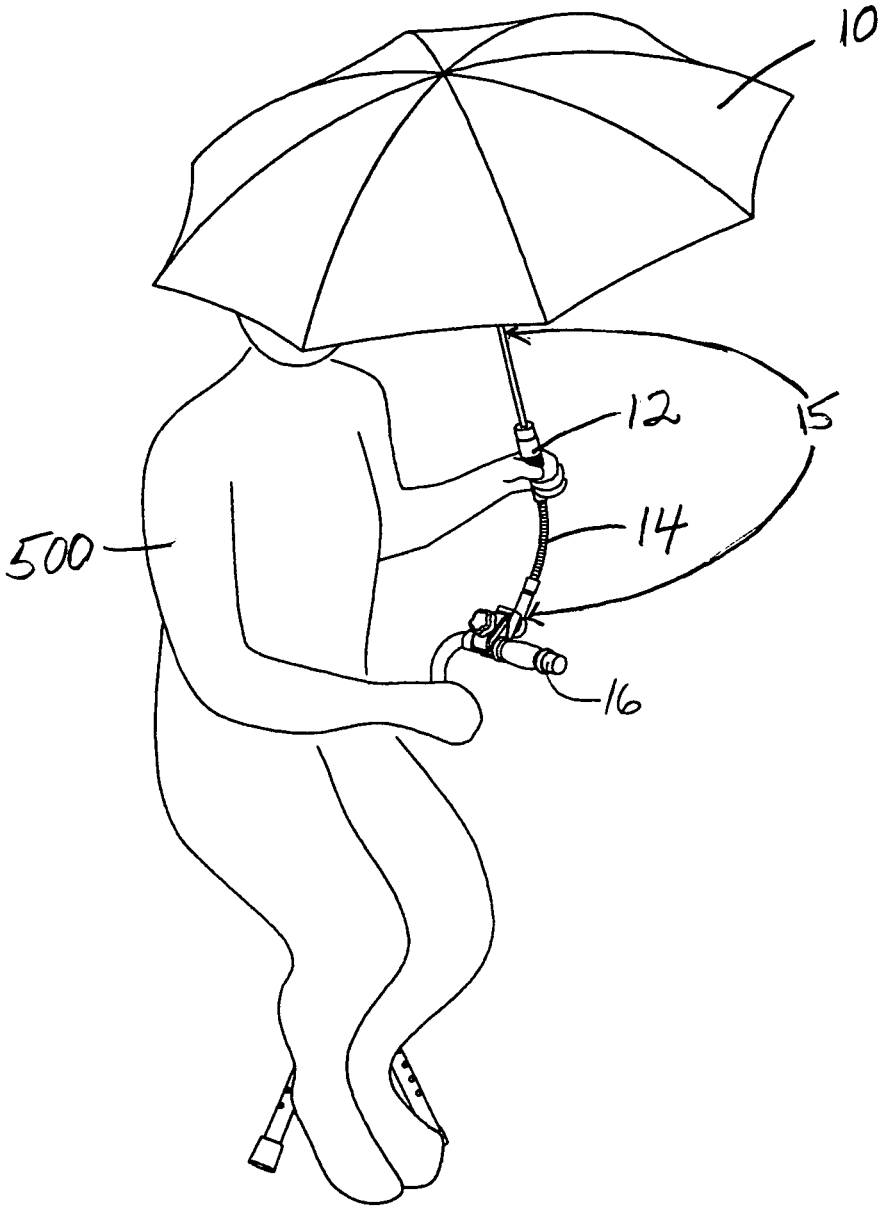
FIG. 7 shows a seated person with the umbrella raised and open.
Figure 8:
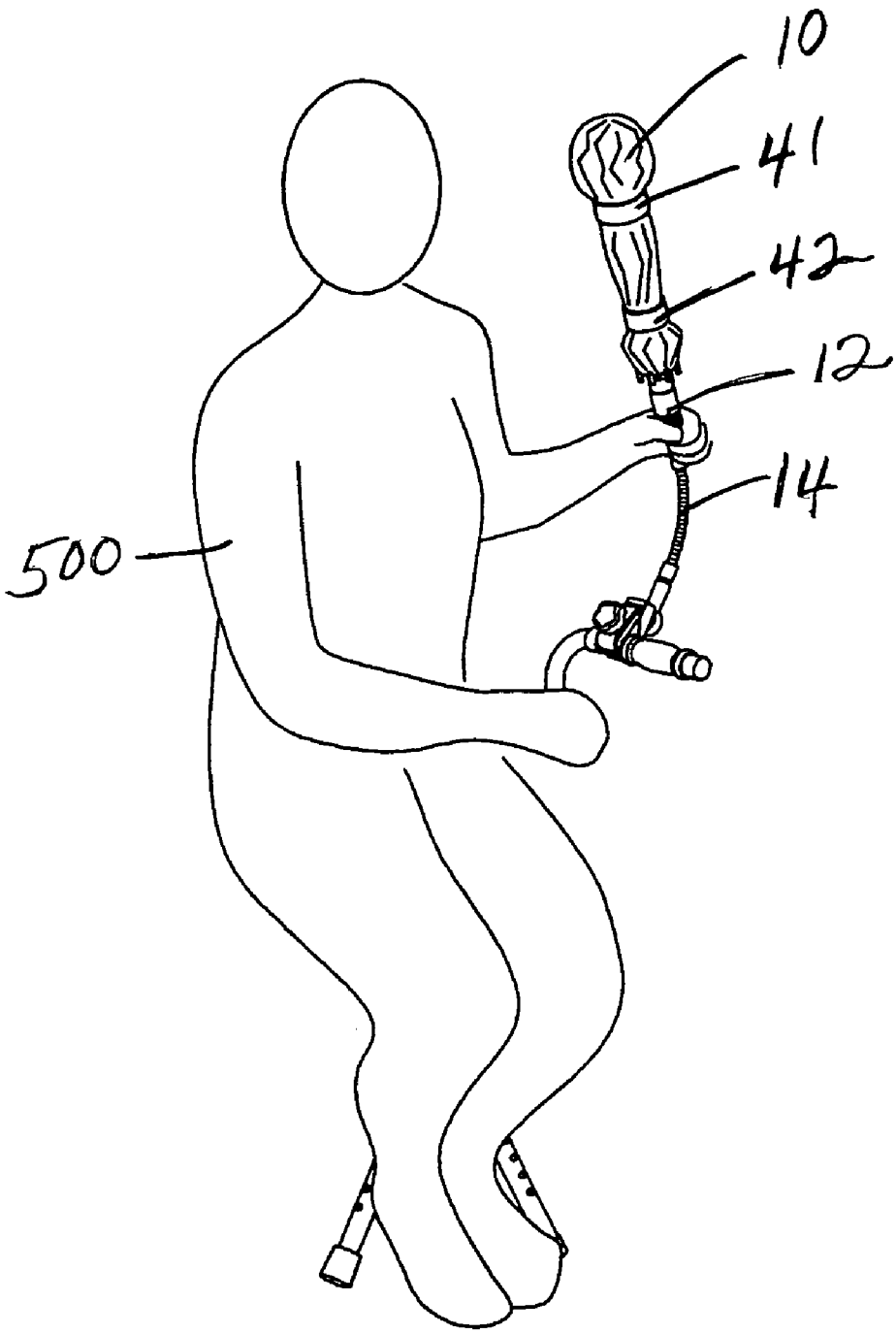
FIG. 8 shows a seated person preparing to open the raised umbrella.

FIG. 7 shows the seating device being used as a chair by a person 500 who grasps the socket-like connection 12 to move the flexible tubular connection 14 and thereby position the umbrella 10 as desired. There are unlimited adjustments and positions that can be assumed with the novel arrangement of the umbrella shaft 15 for the present invention. FIG. 6 shows person 500 with the umbrella closed and secured with fasteners 41 and 42. The person can straddle the seat with the leg 22 between their legs.

Figures 9, 10, 11:
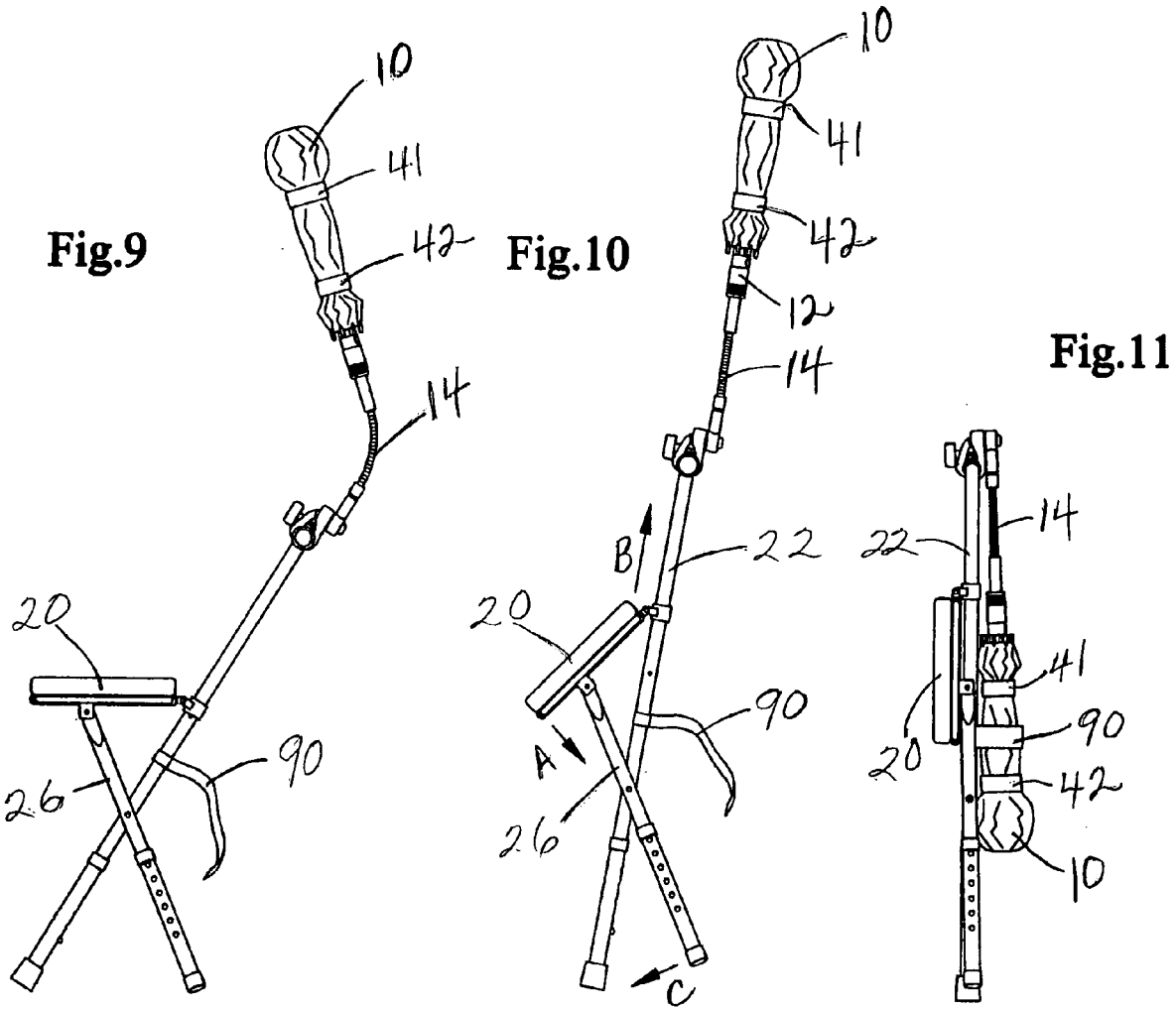
FIG. 9 is a side view of the seating device with the umbrella raised and closed.
FIG. 10 is a side view of the seating device beginning to fold into a collapsed position.
FIG. 11 is a side view of the seating device completely folded with the umbrella down and closed.

FIG. 9 is a side view of the seating device with the umbrella 10 closed, secured with fasteners 41, 42 and flexed slightly forward with the flexible tubular connection 14. Fasteners 41 and 42 are sewn into the seams of the umbrella 10. The seat 20 is positioned to receive an occupant and a fastener strap 90 fits as a sleeve over the straight cylindrical leg 22 and extends downward. Optionally, fastener 42 could be elongated and serve as a dual fastener for closed umbrella 10 and for securing the closed umbrella 10 to the straight cylindrical leg 22. FIG. 10 shows the seating device beginning to fold. The communicating hinges 50 (not shown), 52 under the bottom of the seat 20 are releasing in the direction of arrow A and urging the hinge or coupling 30 to move upward in the direction of arrow B, while supporting K-shaped legs 24 (not shown) and 26 move to a parallel position with leg 22 in the direction of arrow C. FIG. 11 is a side view of the fully collapsed seating device with the closed umbrella 10 parallel to the seat 20 and leg assemblies 22, 24, 26 and fastener 90 is securing the closed umbrella 10 to the straight cylindrical leg 22.

Figure 14:
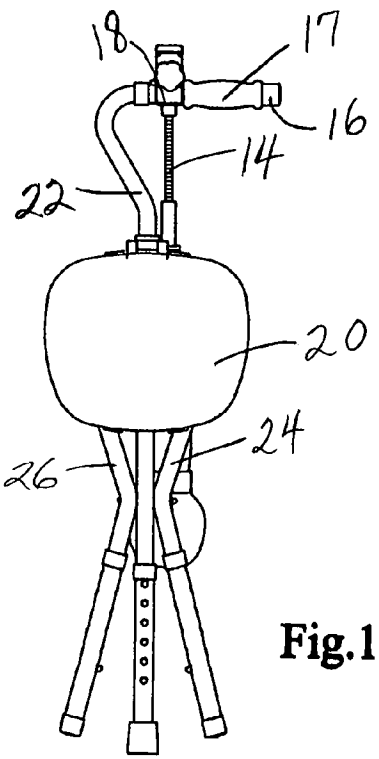
FIG. 14 is a view of the seating device of FIG. 11 with the seating surface collapsed in a vertical position with cane handle positioned for user's right hand.
Figure 13:
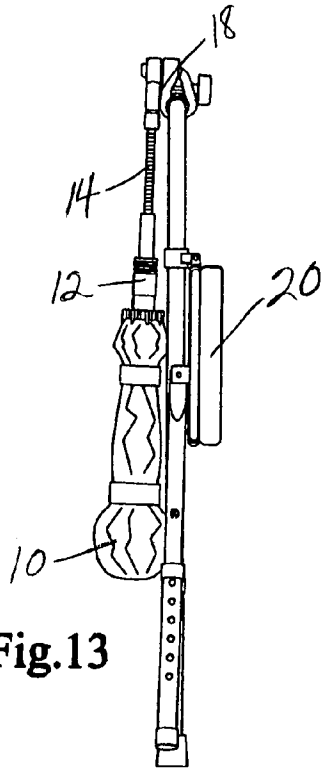
FIG. 13 is a side view of the seating device of FIG. 11.
Figure 12:
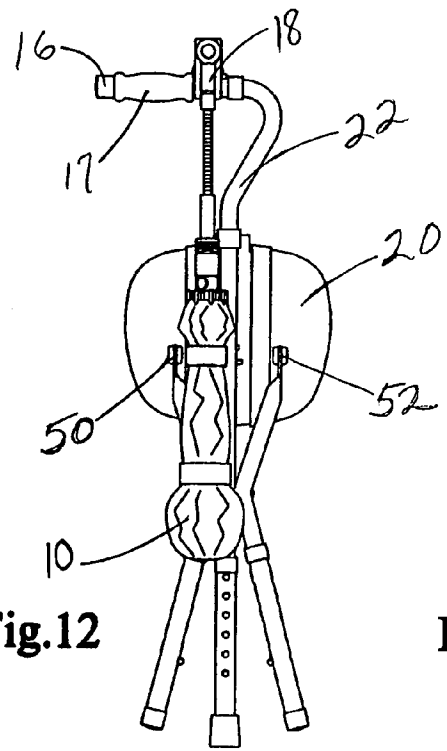
FIG. 12 is a view of the seating device of FIG. 11 with the umbrella strapped in a closed position with cane handle positioned for user's left hand.
Figure 15:
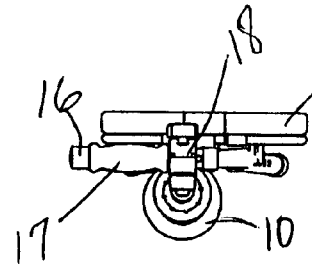
FIG. 15 is a plan view of the seating device of FIG. 11.

FIGS. 12–15 provide the following views of the completely folded and collapsed seating device. FIG. 12 is a view of folded, collapsed seating device when a user is holding the cane in the left hand for walking or hiking. FIG. 13 is a side view of FIG. 12. FIG. 14 is a view of the folded, collapsed seating device being held in the right hand of a user employing the device as a cane. FIG. 15 is a plan view of the collapsed device showing how compact and portable it can be, without any loose parts.

Figure 20:
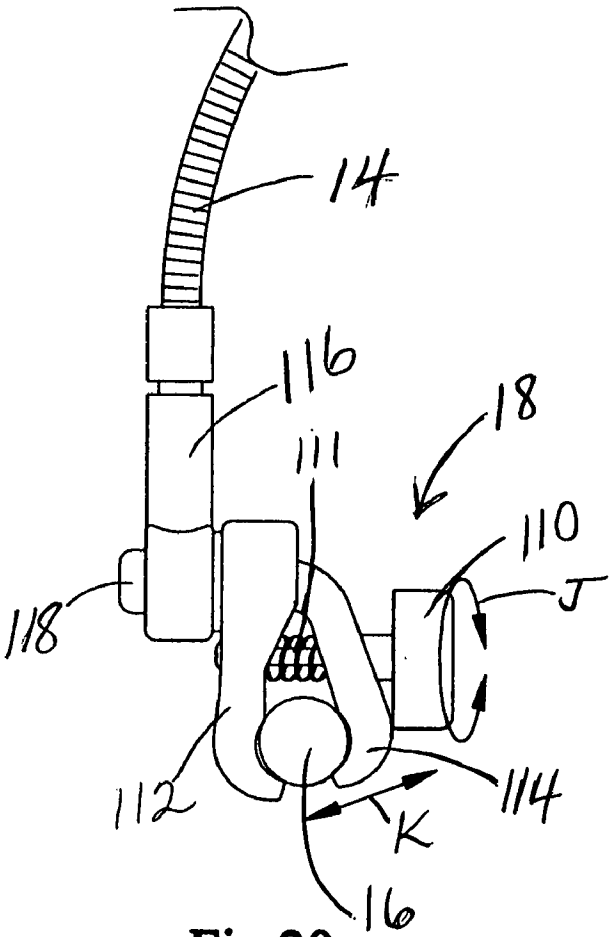
FIG. 20 is a side view highlighting the clamping action of the rotating handle action.
Figures 21, 22, 23:
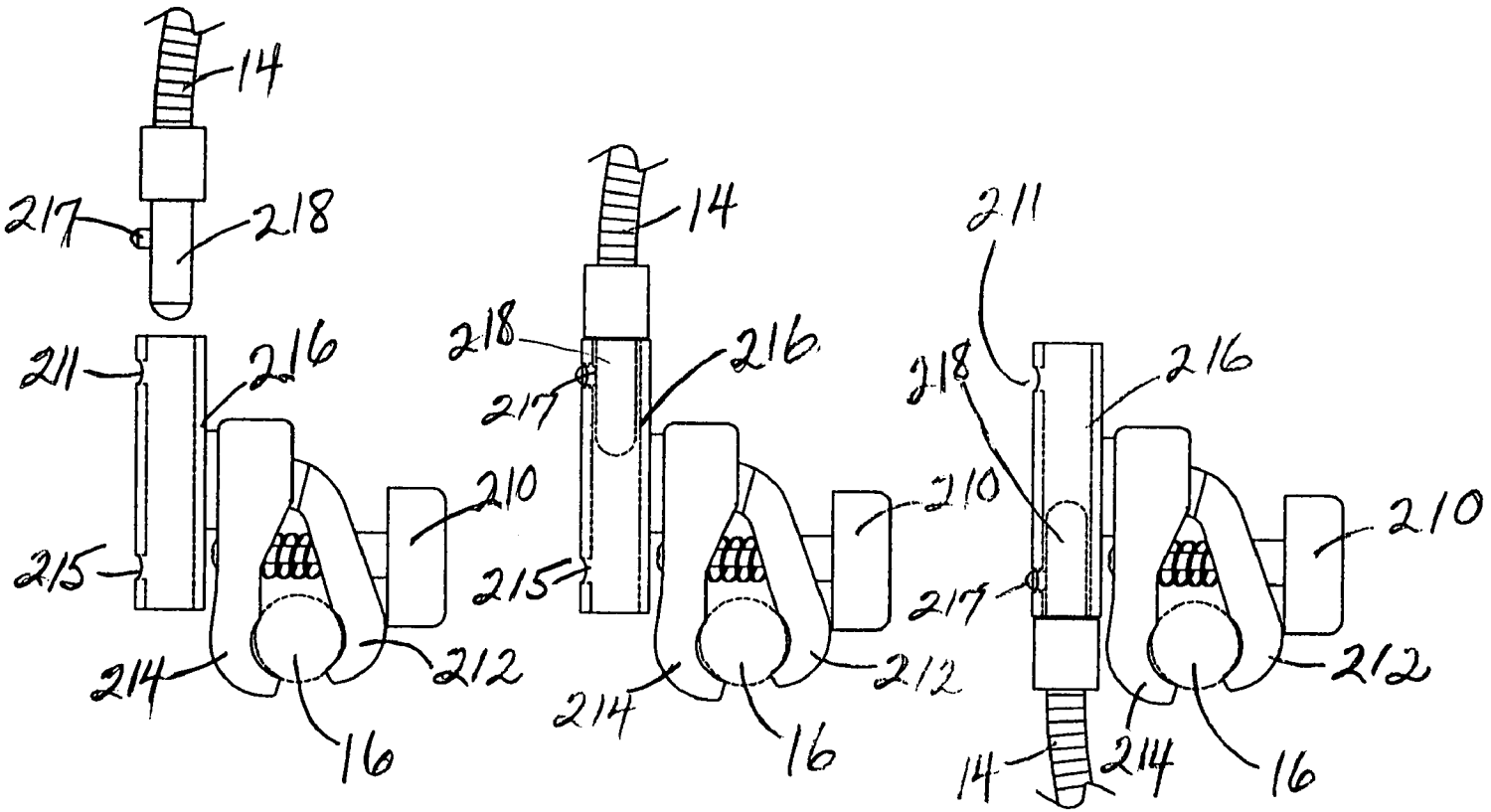
FIG. 21 is a side view of the rotating yoke with the umbrella support removed.
FIG. 22 is a side view of the rotating yoke with the umbrella inserted in a raised position.
FIG. 23 is a side view of the rotating yoke with the umbrella lowered to a position 180 degrees from FIG. 22.

Referring now to FIGS. 16 to 23, the primary focus is on the clever and unusual yoke 18 that secures the umbrella 10 and shaft 15 to cane handle 16, including an alternate embodiment for the umbrella shaft. In FIG. 16, the bottom of seat 20 shows the communicating hinges 50 and 52 and the placement of a U-shaped clip 54 to hold the long straight cylindrical leg 22 in the collapsed position. The location of yoke 18 on handle 16 is also shown. FIG. 16A shows a knob 110 that is spring loaded (see 111 FIG. 20) and used to tighten the gripping parts 112 and 114 to handle 16. Also molded into this yoke 18 is a socket 116 to hold the lower most end of the umbrella shaft 15. The socket 116 is connected to a rotating mechanism with a button release 118. Another button 120 is used to release the handle 16 so that the yoke mechanism can rotate 360 degrees in the direction of arrow F. FIG. 17 illustrates the rotation of yoke 18 and the attached umbrella 10 to a position that is perpendicular to handle 16. FIG. 18 shows the rotation of yoke 18 and the attached umbrella 10 to a position that is parallel with the straight cylindrical leg 22 in a fully collapsed position. FIGS. 16, 17 and 18 show that by pressing a spring biased button or nipple 120 located at the upper most end of leg 22 and protruding through an engaging cavity on cane handle 16, it allows handle 16 to rotate yoke 18 a total of approximately 180 degrees from the raised position in FIG. 16 to the collapsed position in FIG. 18. Thus, by depressing button 120, the handle 16 which is an outer cylinder, covered by a rubber gripping surface 17, is released and free to rotate 360 degrees around the inner, upper most tubular end of the straight cylindrical leg 22. Another embodiment of the yoke clamp is shown in FIGS. 21 to 23 show a fixed handle that allows the yoke clamp 18 to do the work of raising and lowering the umbrella.

Figure 19:
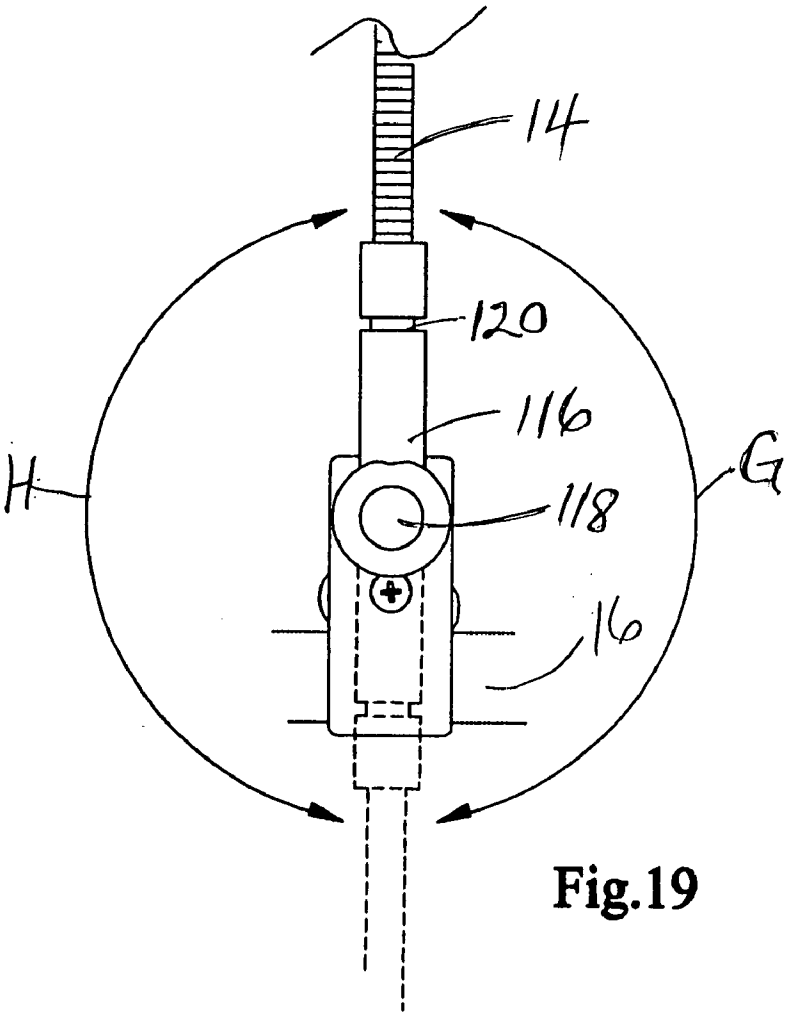
FIG. 19 is a front view of the rotating yoke detail.

FIG. 19 shows the function of button 118, which is attached to socket 116 that receives the lower most end 120 of the flexible metal tubing 14. When button 118 is pressed inward, it releases a locking mechanism that holds the umbrella shaft in a given position. Thus, when button 118 is engaged, the yoke and attached umbrella can be rotated 180 degrees to the left in the direction of arrow G or 180 degrees to the right in the direction of arrow H. Umbrella rotation can be stopped at any position along the 180 degree rotation arc because of there are notches in increments. and FIG. 20 shows how yoke 18 is clamped to handle 16. When knob 110 is turned in a tightening direction according to arrow J, the clamping jaws 112 and 114 are moved in the direction of arrow K. Rotating knob 110 clockwise can move gripping part 112 and 114 against one another compressing spring 111 there between. Rotating knob 110 counterclockwise reverses the operation and loosens the clamp portion 112, 114 and allows rotation about or around handle 16.

FIGS. 21 to 23 show an alternate embodiment of the yoke 18 wherein the rotating mechanism controlled by button 118 (shown in FIGS. 19 and 20) is replaced by a stationary female socket-like connection 216 with cavities 211 and 215. The female socket-like connection can receive a male connection 218 attached to the lower most end of the flexible metal tubing 14 on the umbrella shaft 15 (not shown). A nipple 217 on male connection 218 can be a spring-biased protrusion that can be retracted under pressure and permitted to protrude and snap into a cavity such as, 211 and 215 when pressure is released. FIG. 22 shows male connection 218 with nipple 217 snapped into female socket-like connection 216 at cavity 211 to position the umbrella shaft 15 (not shown) in an upward vertical position. FIG. 23 shows male connection 218 with nipple 21 snapped into female socket-like connection 216 at cavity 215 to position the umbrella shaft 15 (not shown) in a downward vertical position.

Figure 24:
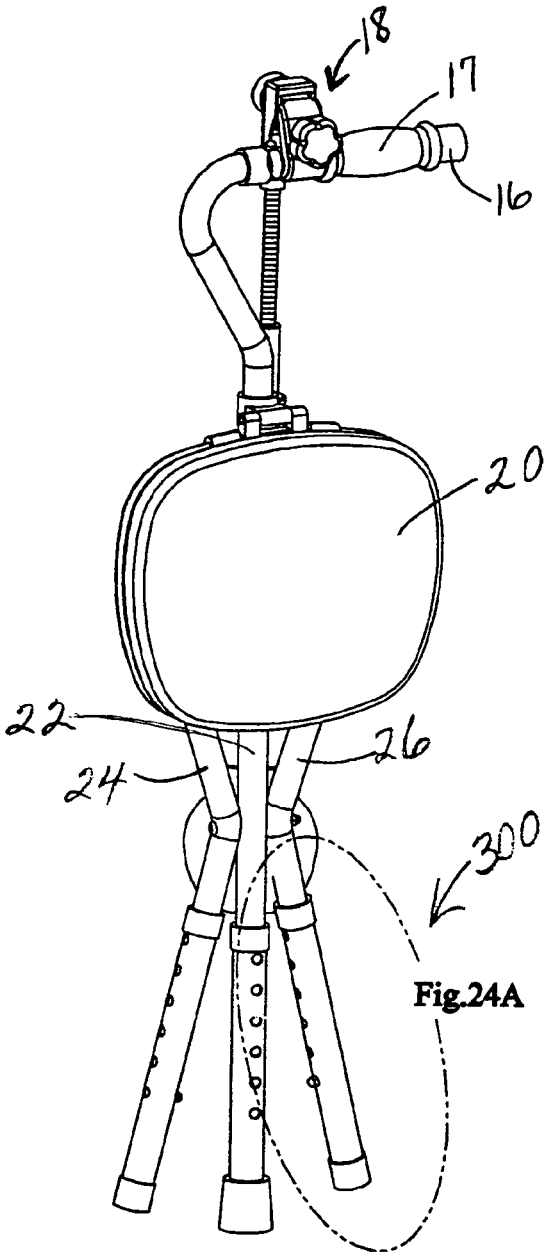
FIG. 24 is a perspective view of the folded seating device highlighting the adjustable legs.
Figure 24A:
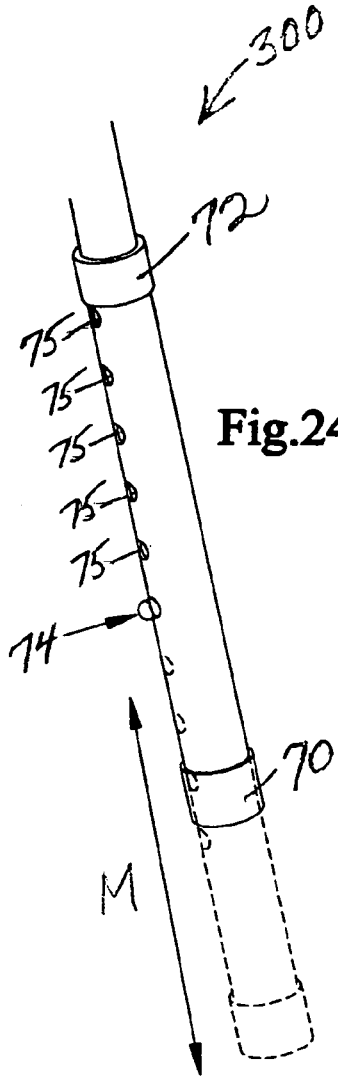
FIG. 24A is an enlarged view of the adjustable leg with telescoping function.

FIG. 24 is a perspective view of the collapsed seating device of the present invention highlighting the position of the telescoping section 300 of the lower most end of the leg assemblies 22, 24, 26. FIG. 24A shows an outer hollow tubular section held by an upper band 72 with an opposing rubber end cap 70. The outer tubular section having a series of cavities or openings 75 is positioned over a slightly smaller hollow tubular section having a spring-biased nipple 74 that is retracted under pressure and allowed to protrude and snap into the cavity or opening 75 thereby extending or shortening the length of each leg in increments, as desired in the direction of arrow M. The telescoping function of each leg is not a limitation of the present invention and can be accomplished by a variety of means, such as disclosed in U.S. Pat. Nos. 6,135,557 and 6,467,843 B1 and incorporated herein by reference The overall vertical dimensions of the legs of the seating device are approximately 18 inches in height from a ground surface to the bottom of the seat 20 when fully retracted. The K-shaped legs are also approximately 18 inches in height from a ground surface to the bottom of the seat 20 when fully retracted. The incremental telescoping adjustments can be used to increase the length of each leg from approximately 1 inch up to approximately 6 inches in 1 inch increments for a total overall increase of 6 inches in height above a ground surface to the bottom of the seat 20. Thus, as can be recognized, any reasonable seating height can be selected, if desired, the seating height can be quite low to the ground, e.g., for a child's chair, or alternatively, a larger seating height can be provided for a tall person's chair. In the preferred embodiment of the present invention, the telescoping legs are comprised of aluminum, due to its superior weight/strength characteristics, ease of fabrication and formation of the final product, and high resistance to atmospheric corrosion. Aluminum requires no protective coating to prevent corrosion, thereby providing a long lasting seating device especially suited for outdoor use.

Figure 25:
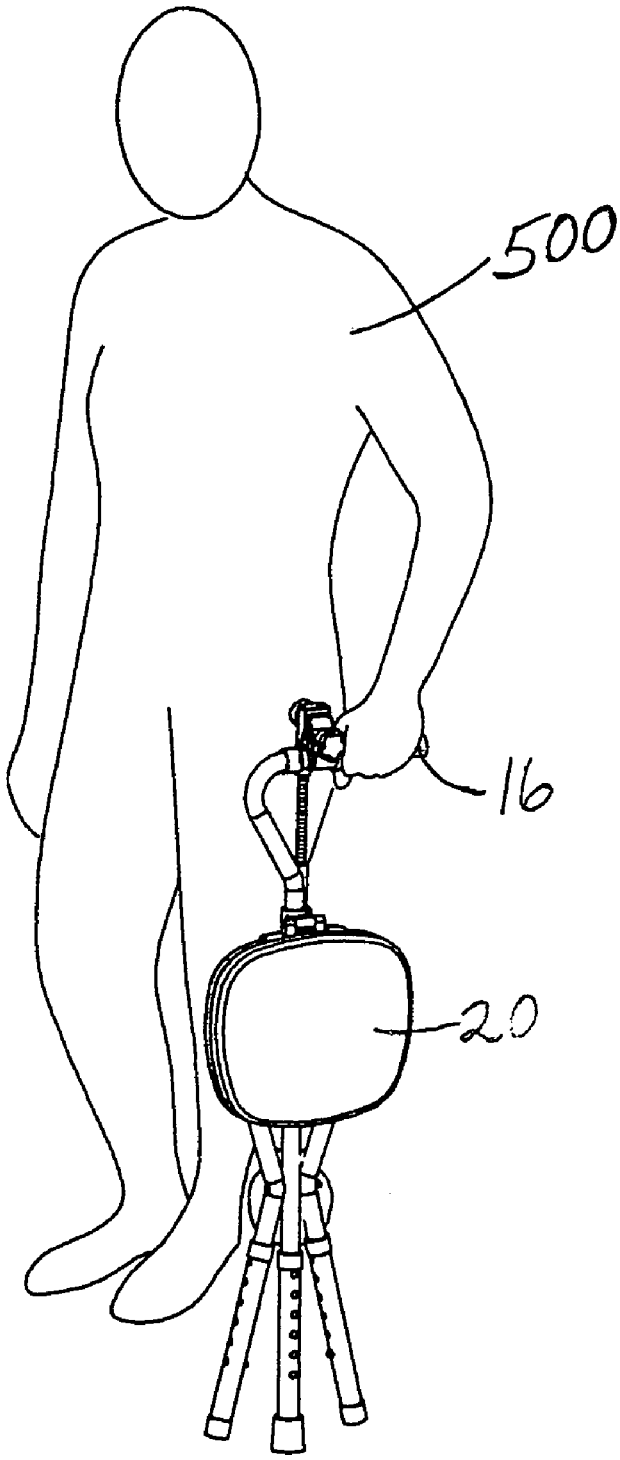
FIG. 25 shows an individual using the folded, collapsed seating device as a cane.

FIG. 25 depicts a person 500 using the left hand to grip handle 16 with the seat 20 facing away from the body and the seating device being used as a walking support or cane.

It is appreciated that the seating device of the present invention has no loose parts. There is nothing to leave behind, nothing to unscrew, nothing to lose or forget. The seating device is of lightweight construction and weighs approximately six pounds, including the detachable cushion for the seat 20, making it ideal for recreational activities such as, camping, hunting, fishing, spectator sports, including baseball, golf tournaments, parades and waiting in line at amusement parks. Indoors and outdoors it can be used as a cane or footrest. Further, the ease of set-up and collapsible folding provides a comfortable, durable, portable seating device.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A portable and collapsible seating device, comprising:

a seat portion;

a plurality of leg members attached to the seat portion for both cross-bracing and supporting the seat portion over a ground surface, the leg members being moveable between an assembled position and a folded position, where the assembled position fully supports weighted objects being placed on the seat portion, and the folded position has the seating device in a collapsed position allowing the seating device to become portable and easy to carry;

one leg member of the plurality of leg members having an upper most portion and a lower most portion, wherein the top of the upper most portion has a cane handle;

an umbrella that is removably attached to the cane handle of the leg member by a clamp that allows up to approximately 180 degree rotation to both the left side and the right side of the seat portion, a telescopic shaft to support the umbrella, a flexible metal tubing section and a yoke to hold the umbrella.

2. The seating device of claim 1 wherein the cane handle has an ergonomic gripping surface.

3. The seating device of claim 1 wherein the seat portion is a tripod stool.

4. The seating device of claim 1 wherein the one of the plurality of leg member is tubular.

5. The seating device of claim 4 wherein the tubular leg member is a telescoping leg.

6. The seating device of claim 1, wherein the seat portion is made of a solid, break-resistant material.

7. The seating device of claim 6, wherein the solid material for the seat portion is selected from the group consisting of polymeric resins, aluminum, and wood.

8. The seating device of claim of claim 1, wherein the umbrella is fitted with hook and loop fasteners attached to a canopy portion of the umbrella.

9. The seating device of claim 8 wherein the fasteners on the umbrella are used to secure the umbrella in a closed position.

10. The seating device of claim 8, wherein the leg member with the cane handle is fitted with a fastener.

11. The seating device of claim 10 wherein the leg member with the cane handle is used to secure the umbrella to the leg member, when the umbrella is closed and not in use.

12. The seating device of claim 1 wherein the umbrella, portion and yoke are made with material with a camouflage design and camouflage colors.

13. A method of converting a device from a cane to a portable seat having legs with an umbrella, comprising the steps of:

folding the seat and the legs into a collapsed position for use as a walking cane; and expanding the seat and the legs outward;

clamping an attachment portion on the umbrella to a cane handle portion on one of the legs that is attached to the seat wherein the clamp allows up to approximately 180 degree rotation to both the left side and right side of the seat;

raising and lowering the umbrella by a telescopic shaft;

bending the umbrella by a flexible metal tubing section adjacent to the telescopic shaft; and opening the umbrella so the device is useful as a chair with a raised umbrella.

14. The method of claim 13, further comprising the step of:

adjusting length of the legs so that the chair is level on uneven terrain surfaces.

15. A portable and collapsible seating device, comprising:

a seat portion;

a plurality of leg members attached to the seat portion for supporting the seat portion over a ground surface, the leg members being moveable between an assembled position and a folded position, where the assembled position fully supports weighted objects being placed on the seat portion, and the folded position has the seating device in a collapsed position allowing the seating device to become portable;

one leg member of the plurality of leg members having a handle;

an umbrella with a support rod having a telescopic portion to raise and lower the umbrella and flexible tubular section for allowing the support rod to be bendable;

a clamp that is removably attached to the handle of the leg member for supporting the umbrella, the clamp allowing up to approximately 180 degree rotation to both the left side and the right side of the seat portion, wherein the portable and collapsible seating device is useful as both a walking cane and a collapsible chair with overhead covering.

* * * * *